US012433424B2

(12) United States Patent
Tsui et al.

(10) Patent No.: US 12,433,424 B2
(45) Date of Patent: Oct. 7, 2025

(54) SYSTEMS, METHODS, AND APPARATUS FOR PROVIDING TRANSLATIONAL MOTION FOR A BASSINET

(71) Applicant: Graco Children's Products, Inc., Atlanta, GA (US)

(72) Inventors: Siu-Lok Tsui, Atlanta, GA (US); Lauren Pusey, Roswell, GA (US); Brian Scott Kelly, Alpharetta, GA (US); Chad Brandon Robbins, Atlanta, GA (US); Zachary Hafner, Kalamazoo, MI (US)

(73) Assignee: Graco Children's Products, Inc., Atlanta, GA (US)

( * ) Notice: Subject to any disclaimer, the term of this patent is extended or adjusted under 35 U.S.C. 154(b) by 196 days.

(21) Appl. No.: 18/497,744

(22) Filed: Oct. 30, 2023

(65) Prior Publication Data

US 2024/0138589 A1 May 2, 2024

Related U.S. Application Data

(60) Provisional application No. 63/421,014, filed on Oct. 31, 2022.

(51) Int. Cl.
*A47D 9/02* (2006.01)

(52) U.S. Cl.
CPC ..... *A47D 9/057* (2022.08)

(58) Field of Classification Search
CPC ..... A47D 9/057; A47D 9/053
See application file for complete search history.

(56) References Cited

U.S. PATENT DOCUMENTS

| | | | |
|---|---|---|---|
| 7,703,848 | B1 | 4/2010 | Cochran et al. |
| 7,895,690 | B2 | 3/2011 | Kovalyak |
| 7,918,742 | B2 | 4/2011 | Clapper et al. |
| 8,844,072 | B2 | 9/2014 | Bellows et al. |
| 8,938,830 | B2 | 1/2015 | Paperno |
| 9,332,859 | B2 | 5/2016 | Murray |
| 9,663,004 | B2 | 5/2017 | Perrin et al. |
| 9,750,350 | B2 | 9/2017 | Armbruster et al. |
| 9,918,561 | B2 | 3/2018 | Perrin et al. |
| 9,955,799 | B2 | 5/2018 | Tadipatri et al. |
| 10,206,850 | B2 | 2/2019 | Dunn et al. |
| 10,238,341 | B2 | 3/2019 | Rubin et al. |
| 10,251,552 | B2 | 4/2019 | Bloch-Salisbury et al. |
| 10,258,761 | B2 | 4/2019 | Smudde |
| 10,324,460 | B2 | 6/2019 | Sandbothe et al. |
| 10,463,168 | B2 | 11/2019 | Karp et al. |
| 10,806,274 | B2 | 10/2020 | Gersin |
| 10,842,292 | B2 | 11/2020 | Paperno |

(Continued)

FOREIGN PATENT DOCUMENTS

| | | |
|---|---|---|
| CN | 204862250 U | 12/2015 |
| CN | 105686473 B | 8/2018 |

(Continued)

*Primary Examiner* — Adam C Ortiz

(74) *Attorney, Agent, or Firm* — Eversheds Sutherland (US) LLP

(57) ABSTRACT

A children's product configured to provide translational motion is disclosed herein. Example products may include a bassinet assembly with a bassinet, a stationary base, and a track assembly configured to engage with the bassinet and the base, wherein the bassinet is configured for translational motion about the stationary base via the track assembly.

18 Claims, 8 Drawing Sheets

(56) References Cited

U.S. PATENT DOCUMENTS

| | | | |
|---|---|---|---|
| 10,863,264 | B2 | 12/2020 | Sampson |
| 10,905,251 | B2 | 2/2021 | Herron |
| 11,013,345 | B2 | 5/2021 | Arnold, IV et al. |
| 11,052,221 | B2 | 7/2021 | Karp et al. |
| 11,054,819 | B2 | 7/2021 | Sandbothe et al. |
| 11,260,198 | B2 | 3/2022 | Rabin et al. |
| 2021/0299398 | A1 | 9/2021 | Chi |
| 2022/0313560 | A1 | 10/2022 | Rawlinson |
| 2022/0354255 | A1 | 11/2022 | Juchniewicz |
| 2022/0362095 | A1 | 11/2022 | Rabin et al. |
| 2023/0071121 | A1 | 3/2023 | Alteon et al. |

FOREIGN PATENT DOCUMENTS

| | | | |
|---|---|---|---|
| CN | 215382767 | U | 1/2022 |
| CN | 215779816 | U | 2/2022 |
| CN | 114727705 | A | 7/2022 |
| CN | 110226858 | B | 9/2022 |
| CN | 115023163 | A | 9/2022 |
| CN | 115088987 | A | 9/2022 |
| CN | 115366976 | B | 1/2023 |
| CN | 113558902 | B | 2/2023 |
| WO | 2022056325 | A1 | 3/2022 |
| WO | 2023018865 | A1 | 2/2023 |

SYSTEMS, METHODS, AND APPARATUS FOR PROVIDING TRANSLATIONAL MOTION FOR A BASSINET

CROSS-REFERENCE TO RELATED APPLICATIONS

This application claims the benefit of U.S. Provisional Application No. 63/421,014, filed on Oct. 31, 2022, which is incorporated herein by reference.

TECHNICAL FIELD

The present disclosure generally relates to bassinets, and more particular, to systems, methods, and apparatus for providing translational motion for a bassinet.

BACKGROUND

Certain ways of configuring a bassinet to be movable are well-known in the art. A conventional bassinet is often configured to be movable to provide a parent or a user with the ability to soothe a child when the child is disposed within the bassinet. Typically, a bassinet can include a component for rocking or a component for moving the bassinet such that the child disposed within the bassinet experiences a rocking or swaying movement. The components may be configured for automatic movement and/or manual movement.

However, many conventional movable bassinets are large and have many components, making them difficult to assembly and/or move as needed.

SUMMARY

The present disclosure generally relates to a system for providing translational motion for a children's product. In embodiments, the present disclosure describes a bassinet assembly having a bassinet, a stationary base, and at least one track assembly including an inverted curved track and a wheel assembly, where the track assembly is configured to engage with the bassinet and the base. The bassinet may be configured for translational motion about the stationary base via the at least one track assembly.

In some embodiments, the at least one track assembly includes at least one idle track assembly and a drive track assembly, wherein the drive track assembly is configured to effectuate the translational motion of the bassinet. The drive track assembly may have a drive track and a drive wheel assembly configured to actively rotate the drive wheel assembly. The drive assembly may also include a motor configured to power the rotation of the drive wheel assembly.

In some embodiments, the inverted curved track is fixedly attached to a bottom side of the bassinet and wheel assemblies are disposed within base. The inverted curved track may include a track portion and a base portion, wherein the base portion is fixedly attached to the bottom side of the bassinet such that a concave curved edge of the inverted curved track faces towards the stationary base. The wheel assembly may include a wheel and an axle, wherein the axle is fixedly attached within the stationary base, and wherein the wheel is rotatably disposed around the axle.

In some embodiments, the stationary base has at least one rectangular cutout on a top side thereof configured to receive the track therein, and wherein at least a portion of the track is disposed within the stationary base when the track is positioned within the rectangular cutout. In embodiments, the track includes a retention member configured to maintain the one track within the rectangular cutout. The rectangular cutout may be sized to permit translational motion of the track within the rectangular cutout, wherein the translational motion of the track corresponds with proportional translational motion of the bassinet.

In some embodiments, the bassinet assembly also includes a controller configured to direct the translational motion of the bassinet. The bassinet assembly may also include a control panel configured to send a signal to the controller instructing the controller to execute a command regarding the translational motion of the bassinet. The command regarding the translational motion of the bassinet may be a command regarding a speed, a magnitude, or a duration of the translational motion.

In embodiments, a bassinet assembly having a bassinet, a stationary base, and a plurality of track assemblies is disclosed. In some embodiments, the stationary base may include a primary base portion and a top base portion positioned atop the primary base portion. In some embodiments, each of the plurality of track assemblies has a curved track and a wheel assembly. The curved track may be fixedly attached to the bassinet, and the wheel assembly may be disposed within the primary base portion of the stationary base. In some embodiments, at least one of the plurality of track assemblies is a drive assembly, wherein the wheel assembly is a drive wheel assembly configured to effectuate translational motion of the bassinet about the stationary base.

In some embodiments, the bassinet assembly also includes a control panel and a controller, where the control panel is configured to receive a user input regarding at least one setting for the bassinet assembly and transmit the user input to the controller, and where the controller is configured to transmit a command to the drive wheel assembly based on the user input. The at least one setting may be a speed of the translational motion for the bassinet, and wherein the user input corresponds with a low speed, a medium speed, or a high speed setting.

In embodiments, a method of implementing translational motion in a children's product is disclosed. The method may include, providing a track assembly configured to engage the children's product and a stationary base and causing the track assembly to enact translational motion. In some embodiments, the track assembly includes a track portion fixedly attached to the children's product and at least partially disposed within the stationary base, and a wheel assembly disposed within the stationary base. The track portion and the wheel assembly may be in contact within the stationary base. In some embodiments, the translational motion is effectuated via contact between the track portion and the wheel assembly.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout the present disclosure, depending on the context, singular and plural terminology may be used interchangeably.

Figure 1:
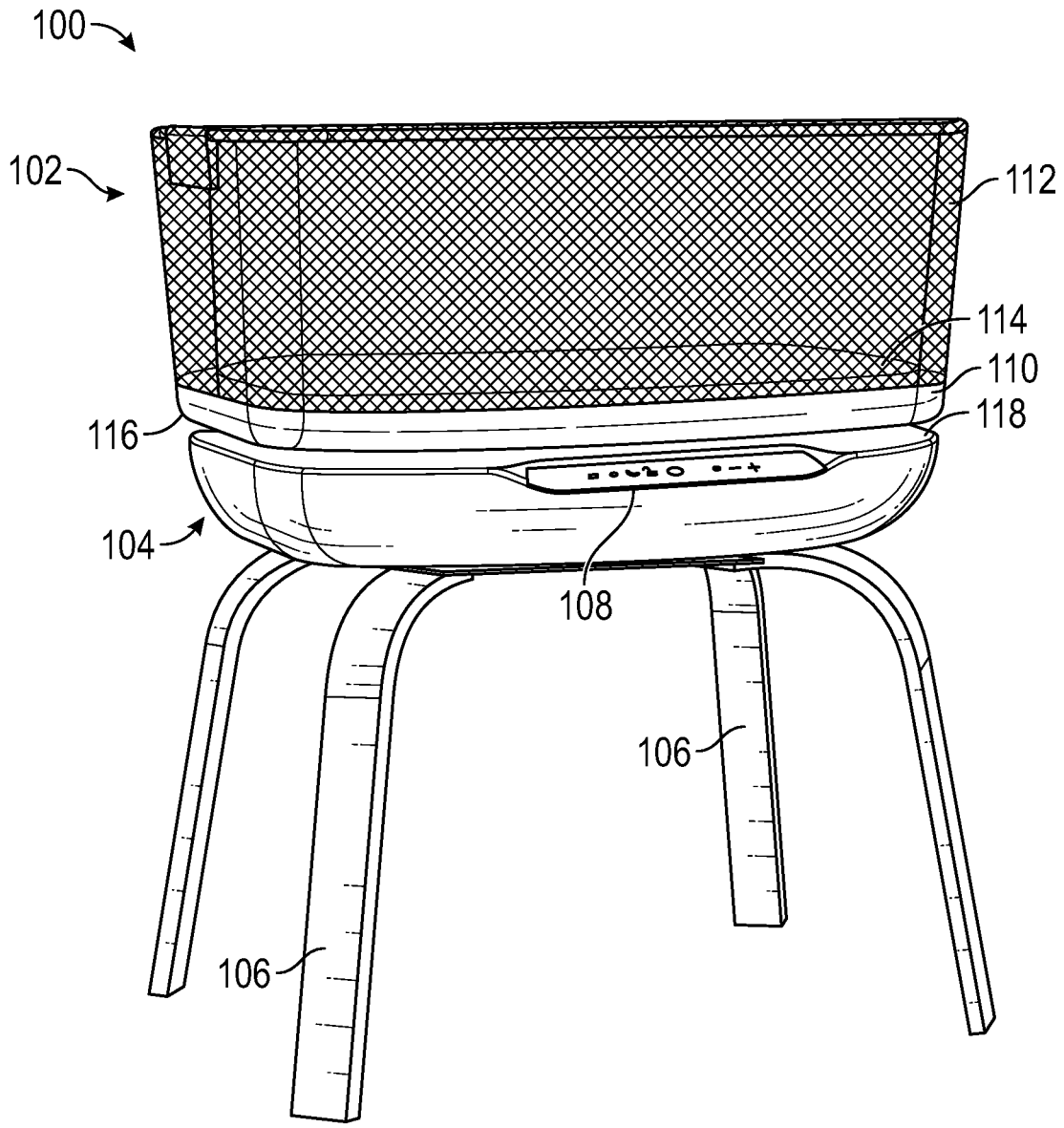
FIG. 1 is a front perspective view of a movable bassinet assembly in accordance with one or more example embodiments of the present disclosure.

The present disclosure will now provide a more detailed and specific description that will refer to the accompanying drawings. The drawings and specific descriptions of the drawings, as well as any specific or other embodiments, discussed, are intended to be read in conjunction with the entirety of the present disclosure.

DETAILED DESCRIPTION

Example embodiments will now be described more fully hereinafter with reference to the accompanying drawings, in which example embodiments are shown. The concepts disclosed herein may, however, be embodied in many different forms and should not be construed as limited to the example embodiments set forth herein; rather, these embodiments are provided so that this disclosure will be thorough and complete, and will fully convey the scope of the concepts to those skilled in the art. Like numbers refer to like, but not necessarily the same or identical elements throughout.

Certain relationships between features of the bassinet are described herein using the term "substantially" or "substantially equal." As used herein, the terms "substantially" and "substantially equal" indicate that the equal relationship is not a strict relationship and does not exclude functionally similar variations therefrom. Unless context or the description indicates otherwise, the use of the term "substantially" or "substantially equal" in connection with two or more described dimensions indicates that the equal relationship between the dimensions includes variation that, using mathematical and industrial principles accepted in the art (e.g., rounding, measurement, of other systematic errors, manufacturing tolerances, etc.), would not vary the least significant digit of the dimensions. As used herein, the term "substantially parallel" indicates that the parallel relationship is not a strict relationship and does not exclude functionally similar variations therefrom. As used herein, the term "substantially orthogonal" or "substantially perpendicular" indicates that the orthogonal relationship is not a strict relationship and does not exclude functionally similar variations therefrom.

This disclosure relates to, among other things, systems, methods, and apparatuses for providing translational motion for a bassinet. In embodiments, a system, method, and apparatus for providing translational motion for a bassinet may be provided. Embodiments of the disclosure can provide a technical solution to the problem of providing an easy to assembly bassinet configured for translational motion.

In one embodiment, a bassinet assembly having a bassinet, a stationary base, and at least one track assembly is provided. The at least one track assembly may include an inverted curved track and a wheel assembly, where the track assembly is configured to engage with the bassinet and the base. The bassinet may be configured for translational motion about the stationary base via the at least one track assembly.

In some embodiments, the at least one track assembly includes at least one idle track assembly and a drive track assembly, wherein the drive track assembly is configured to effectuate the translational motion of the bassinet. The drive track assembly may have a drive track and a drive wheel assembly configured to actively rotate the drive wheel assembly. The drive assembly may also include a motor configured to power the rotation of the drive wheel assembly.

In some embodiments, the inverted curved track is fixedly attached to a bottom side of the bassinet and wheel assemblies are disposed within base. The inverted curved track may include a track portion and a base portion, wherein the base portion is fixedly attached to the bottom side of the bassinet such that a concave curved edge of the inverted curved track faces towards the stationary base. The wheel assembly may include a wheel and an axle, wherein the axle is fixedly attached within the stationary base, and wherein the wheel is rotatably disposed around the axle.

In some embodiments, the stationary base has at least one rectangular cutout on a top side thereof configured to receive the track therein, and wherein at least a portion of the track is disposed within the stationary base when the track is positioned within the rectangular cutout. In embodiments, the track includes a retention member configured to maintain the one track within the rectangular cutout. The rectangular cutout may be sized to permit translational motion of the track within the rectangular cutout, wherein the translational motion of the track corresponds with proportional translational motion of the bassinet.

In some embodiments, the bassinet assembly also includes a controller configured to direct the translational motion of the bassinet. The bassinet assembly may also include a control panel configured to send a signal to the controller instructing the controller to execute a command regarding the translational motion of the bassinet. The command regarding the translational motion of the bassinet may be a command regarding a speed, a magnitude, or a duration of the translational motion.

In another embodiment, a bassinet assembly having a bassinet, a stationary base, and a plurality of track assemblies is provided. In some embodiments, the stationary base may include a primary base portion and a top base portion positioned atop the primary base portion. In some embodiments, each of the plurality of track assemblies has a curved track and a wheel assembly. The curved track may be fixedly attached to the bassinet, and the wheel assembly may be disposed within the primary base portion of the stationary base. In some embodiments, at least one of the plurality of track assemblies is a drive assembly, wherein the wheel assembly is a drive wheel assembly configured to effectuate translational motion of the bassinet about the stationary base.

In some embodiments, the bassinet assembly also includes a control panel and a controller, where the control panel is configured to receive a user input regarding at least one setting for the bassinet assembly and transmit the user input to the controller, and where the controller is configured to transmit a command to the drive wheel assembly based on the user input. The at least one setting may be a speed of the translational motion for the bassinet, and wherein the user input corresponds with a low speed, a medium speed, or a high speed setting.

In a further embodiment, a method of implementing translational motion in a children's product is provided. The method may include, providing a track assembly configured to engage the children's product and a stationary base and causing the track assembly to enact translational motion. In some embodiments, the track assembly includes a track portion fixedly attached to the children's product and at least partially disposed within the stationary base, and a wheel assembly disposed within the stationary base. The track portion and the wheel assembly may be in contact within the stationary base. In some embodiments, the translational motion is effectuated via contact between the track portion and the wheel assembly.

Turning to the figures, FIG. 1 depicts a movable bassinet assembly 100 according to one or more embodiments of the disclosure. The movable bassinet assembly 100 can include a bassinet 102, a stationary base 104, and a track assembly (not shown) disposed between the bassinet 102 and the stationary base 104 to effect translational motion of the bassinet 102 with respect to the stationary base 104. The stationary base 104 may be supported by a plurality of legs 106 attached to an underside of the stationary base 104. In some embodiments, the legs 106 may have a half-U-shape or a substantially half-U-shape. The legs 106 may be configured to be attached to an underside of the stationary base 102. In some embodiments, the upper surface of each of the half-U-shaped legs 106 may be configured to be attached to the underside of the stationary base 102. In some embodiments, the lower surfaces of each of the half-U-shaped legs 106 may be configured to rest on a surface, e.g., the ground. In some embodiments, a power source (not shown) may be included in at least one of the plurality of legs 106. The power source may include a battery, a charging port, or a port for connecting the bassinet assembly 100 to an external power source.

The stationary base 104 may also include a control panel 108 configured to control the motion of the bassinet 102. In embodiments, the control panel 108 includes a setting selection, where the user may, for example, select the speed at which the bassinet 102 moves. In other embodiments, the control panel 108 may include a wireless connectivity indicator and/or controls for providing secondary stimulation such as sound and/or tactile stimulation (as described in greater detail with respect to FIGS. 6-7). The control panel 108 may also include a power button configured to turn the bassinet assembly 100 on and off.

As depicted in FIG. 1, the bassinet 102 may include a base portion 110 and an enclosure portion 112. The base portion 110 may have a mattress side 114 onto which a mattress is placed so that the baby may lay comfortably in the bassinet, and a bottom side 116 adjacent to, but not in contact with, a top side 118 of the stationary base 102. In use, the bottom side 116 of the bassinet 102 may move laterally relative to the top side 118 of the stationary base. In embodiments, the enclosure portion 112 may include a netting or other fabric enclosure material extending upward from the base 110 to prevent the baby from falling from the bassinet 102.

Figure 2:
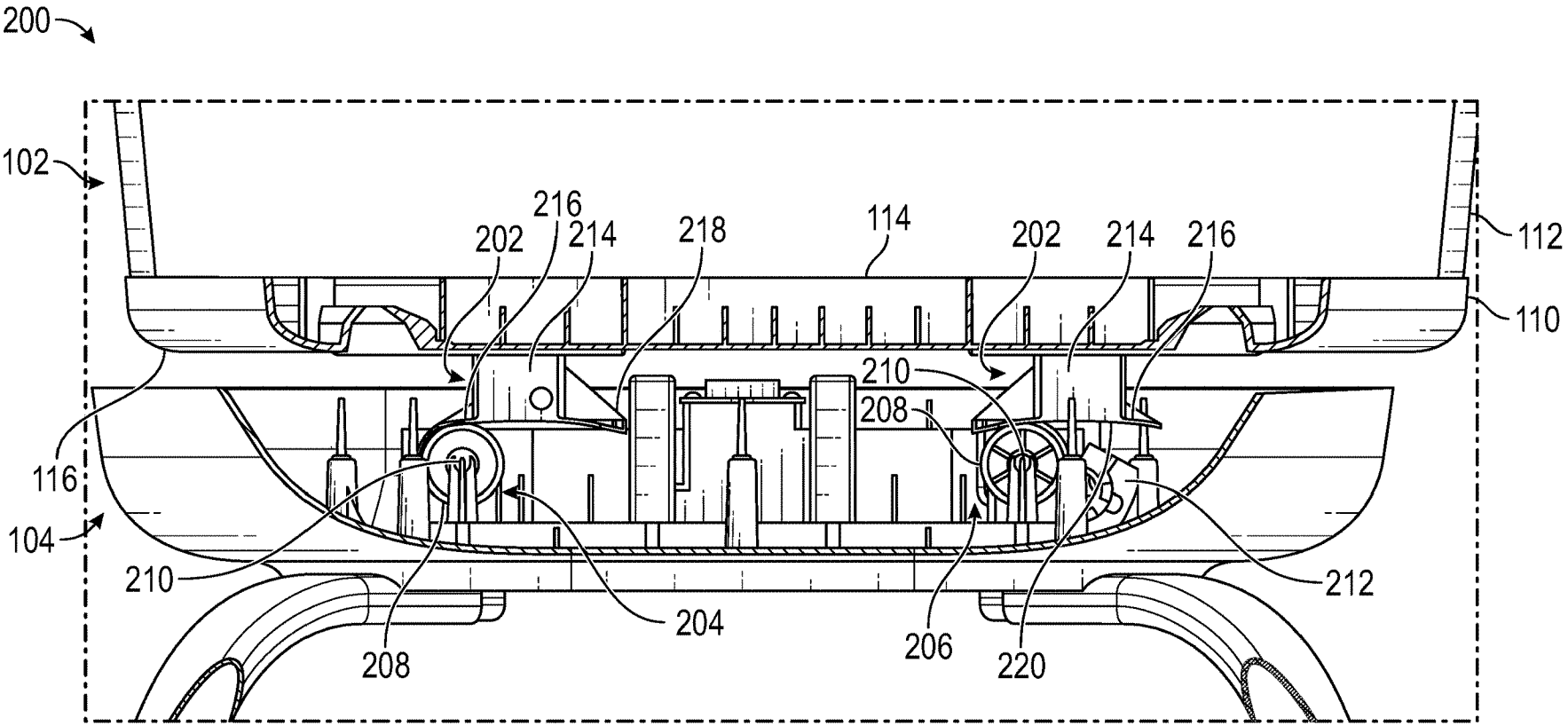
FIG. 2 is a partial cross-sectional view of the movable bassinet assembly of FIG. 1 in accordance with one or more example embodiments of the present disclosure.

FIG. 2 depicts a cross-sectional view the track assembly 200 disposed between the bassinet 102 and the stationary base 104 in greater detail. The track assembly 200 may include two or more track portions 202, at least one idle assembly 204, and at least one drive assembly 206. The inverted (i.e., upside down) nature of the track portion 202 allows the wheels 208 of the track assemblies to remain coupled to the stationary base 104, such that the bassinet 102 can ride on top of the wheels 208 while the base 104 remains stationary. Motorized and/or moving parts (e.g., the drive assembly 206) may therefore be assembled and retained within the stationary base 104, simplifying the user assembly.

Figure 3A:
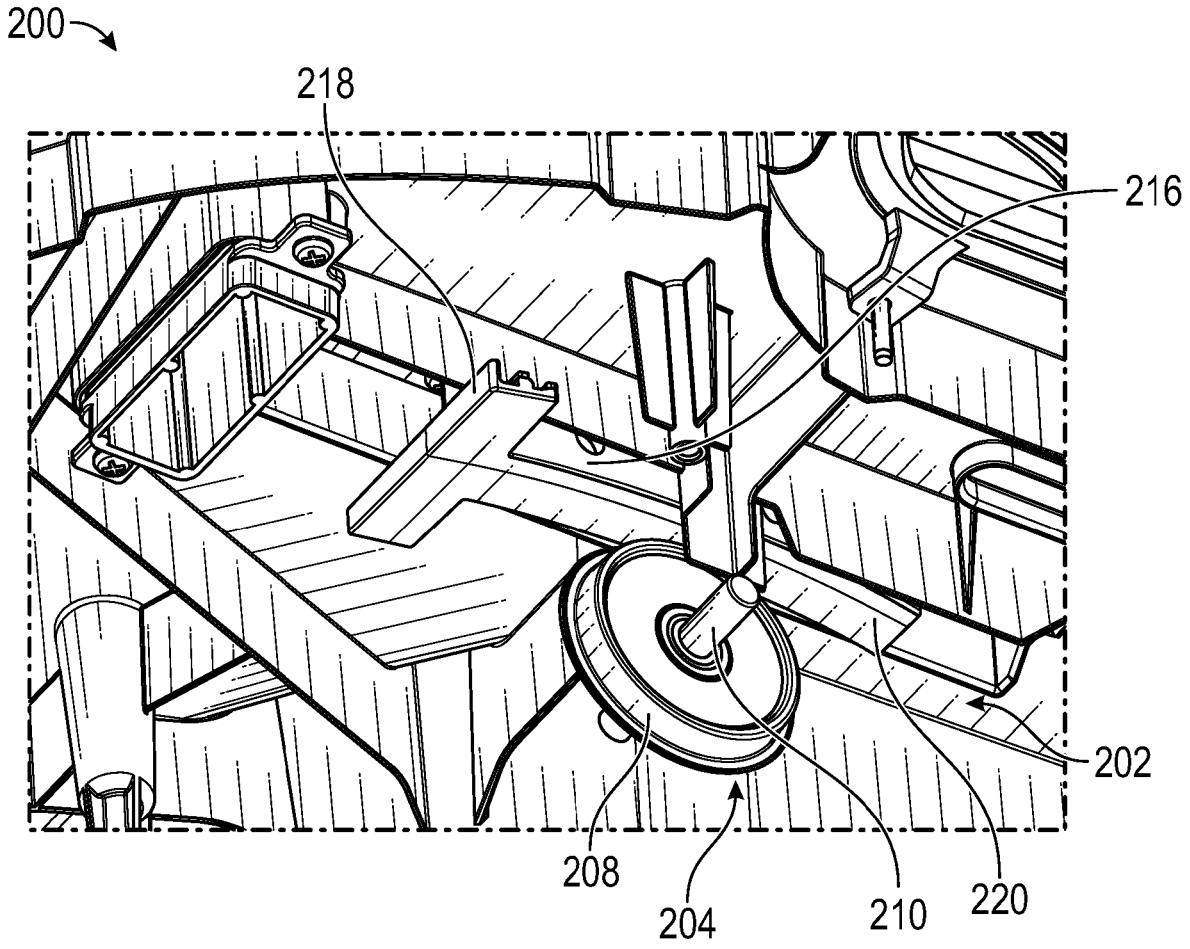
FIG. 3A is a bottom perspective view of a track assembly of the movable bassinet assembly of FIG. 1 in accordance with one or more example embodiments of the present disclosure.
Figure 3B:
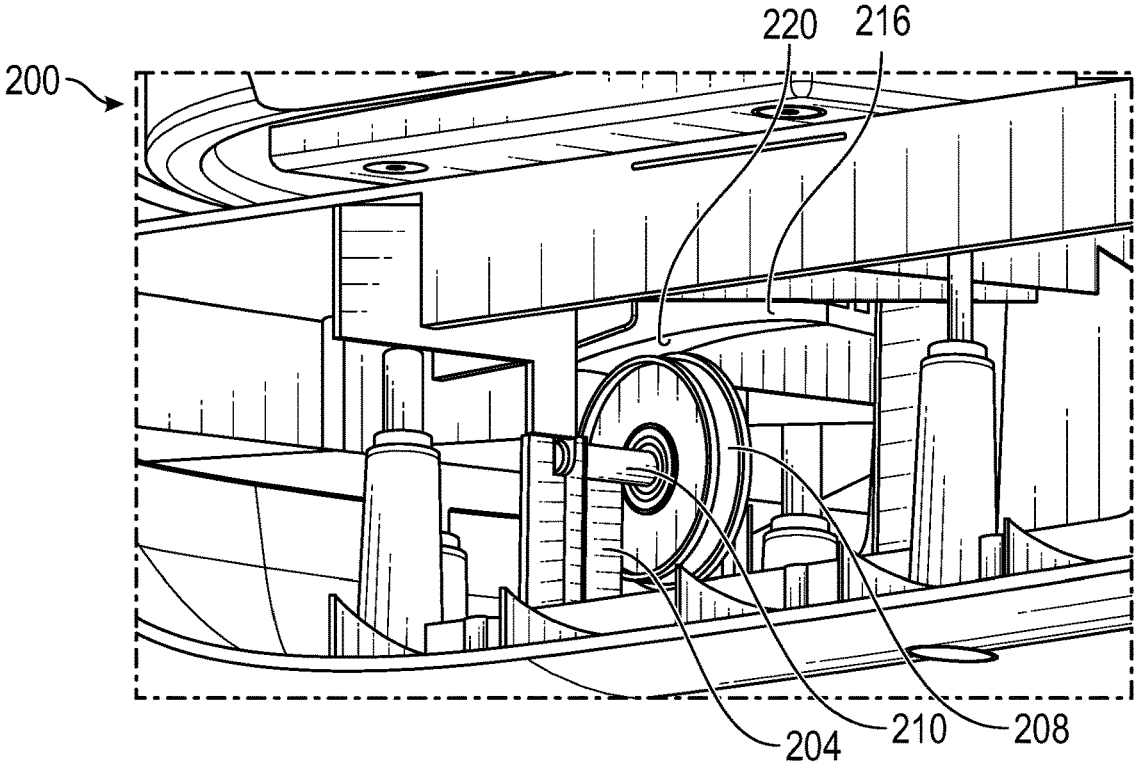
FIG. 3B is a partial perspective view of a track assembly of the movable bassinet assembly of FIG. 1 in accordance with one or more example embodiments of the present disclosure.
Figure 3C:
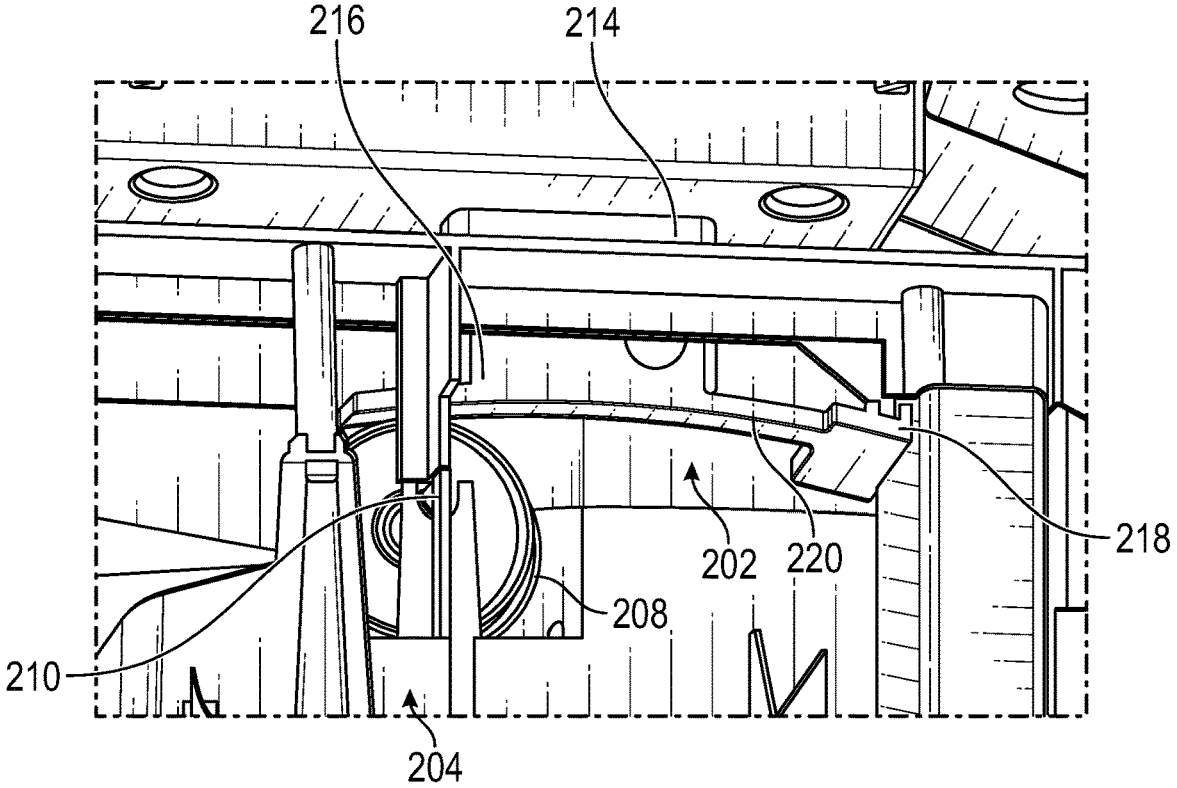
FIG. 3C is a partial front view of a track assembly of the movable bassinet assembly of FIG. 1 in accordance with one or more example embodiments of the present disclosure.

FIGS. 3A-3C depict the track portion 202 and wheels 208 in greater detail. As also shown in FIG. 2, the track portion 202 may be at least partially disposed within the stationary base 104 so that, when assembled, the track portions 202 is configured to contact the wheels 208 of the idle assemblies 204 and the drive assembly 206. In some embodiments, the wheels 208 may be a similar rotating component, such as a roller or other rotating component known to those skilled in the art. In embodiments, at least one wheel 208 or rotating component is operationally coupled with a driving mechanism configured to rotate the wheel 208 when the movable bassinet assembly 100 is in use. In embodiments, the user may select different level and/or patterns of motion, which may be controlled by the speed, activation pattern, etc. of the driver. The driver may be controlled by the user via the control panel on the stationary base portion. The rotational movement of the driver and corresponding wheel 208 may cause translational movement of the track portion 202 contacting said wheel 208. That translational movement is effective to effectual lateral motion of the bassinet 102, simulating a rocking movement.

Figure 5:
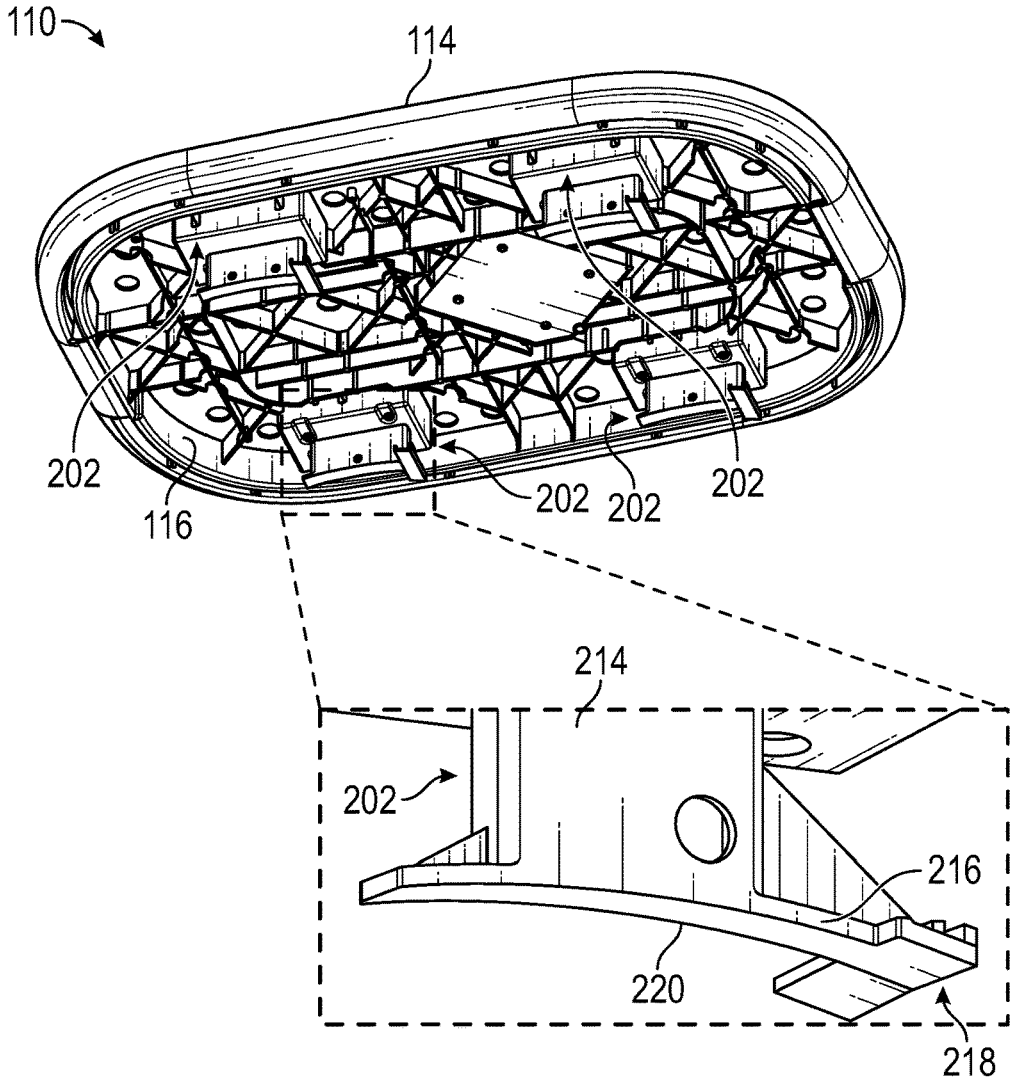
FIG. 5 is a bottom perspective view of a bottom side of a bassinet of the movable bassinet assembly of FIG. 1 in accordance with one or more example embodiments of the present disclosure.

According to a preferred embodiment, the track assembly 200 includes four track portions 202 arranged in a 2×2 array (as shown in FIG. 5), with three respective idle assemblies 204 and one drive assembly 206. The idle assemblies 204 and the drive assembly 206 may generally include a wheel 208 disposed around an axle 210 that is fixed in a stationary position within the stationary base 104.

Figure 4:
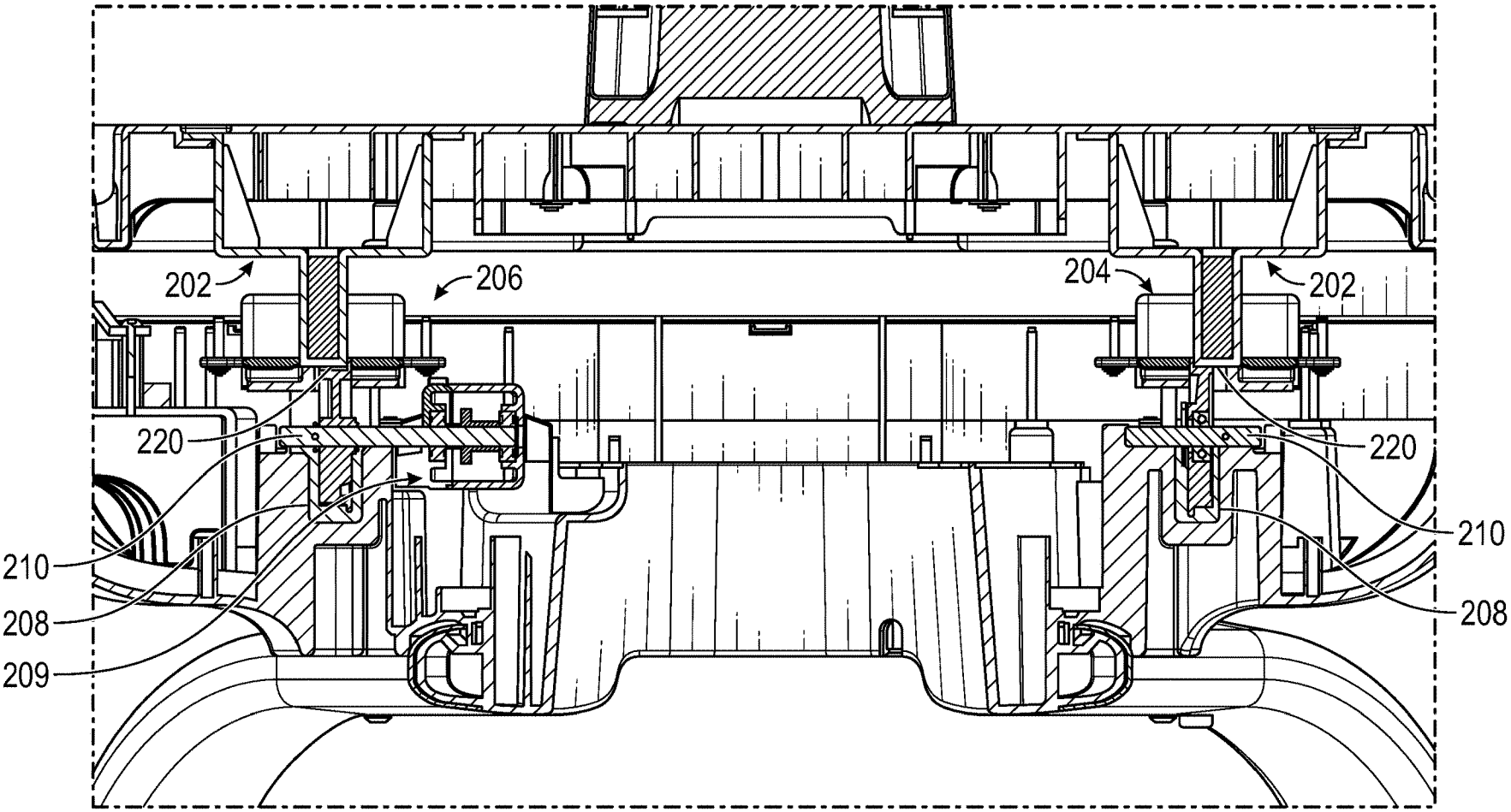
FIG. 4 is a cross-sectional view of track assemblies of the movable bassinet assembly of FIG. 1 in accordance with one or more example embodiments

FIG. 4 depicts a cross-sectional view of the drive assembly 206 in greater detail. The drive assembly 206 may be configured to effect motion in the bassinet 102. In addition to a wheel 208 and a stationary axle 210, the drive assembly 206 may include a motor 209 configured to rotate the wheel 208 about the axle 210. For example, the motor 209 may receive a command from a controller (not shown) directing the output of the motor 209 to rotate the wheel 208 at a predetermined speed that corresponds to the desired speed of the basinet 102. In some embodiments, the wheel 208 may have a rubber surface (not shown) configured to grip the respective track portion 202 as the wheel 208 rotates.

As the wheel 208 of the drive assembly 206 rotates, contact between the wheel 208 and the track portion 202 may cause the track portion 202 to move laterally with respect to the fixed position of the wheel 208. The lateral motion of the track portion 202 may also cause the bassinet 102 to move. Thus, the drive assembly 206 may initiate and perpetuate the translational motion of the bassinet 102 relative to the stationary base 104. The idle assemblies 204 may also help to maintain the translational motion of the bassinet 102 once the motion is initiated by the drive assembly 206. For example, once the bassinet 102 is moving, the track portions 202 associated with each of the idle assemblies 204 will cause the idle assembly 204 wheels 208 to rotate. The track portions 202 may therefore glide along the wheels 208 of the idle assemblies 204 to generate a smooth, rocking motion for the bassinet 102.

In embodiments, the bassinet assembly 100 may have user-selectable settings. For example, the user may select a speed at which the bassinet 102 moves, where the speed is controlled by the motor 209 of the drive assembly 206. In some embodiments, the speed of the bassinet 102 may be a low, medium, or high speed. As previously described with respect to FIG. 1, a user may select the desired speed setting on the control panel 108 of the stationary base 104. The user selection may be transmitted to the controller, which translates the signal into a command for the motor 209 of the drive assembly 206. The motor 209 may rotate the wheel 208 of the drive assembly 206 at a rate that corresponds to the desired speed setting for the bassinet 102.

Referring now to FIG. 5, each track portion 202 may include at attachment portion 214 and a curved track 216, where the attachment portion 214 and the curved track 216 are integrally formed as a single component. The attachment portion 214 may be configured to affix the track assembly 200 to the bottom side 116 of the base portion 110 of the bassinet 102. In some embodiments, the attachment portion 214 may be integral with the bottom side 116 of the bassinet 102. In other embodiments, the attachment portion 214 may be removably attached to the bottom side 116 of the bassinet 102 so that the movable bassinet assembly 100 may be assembled and disassembled as needed.

Figure 6:
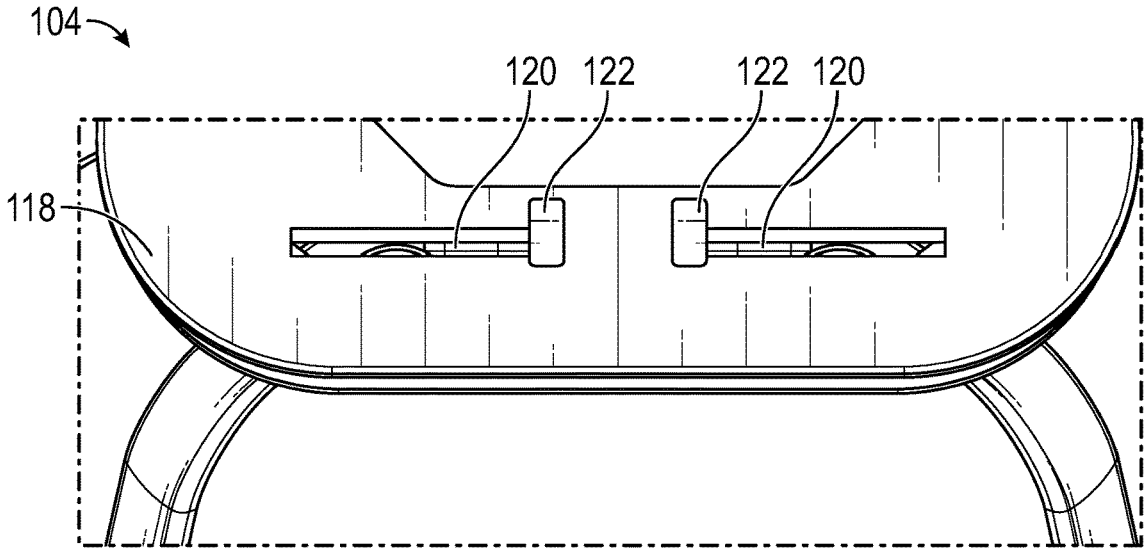
FIG. 6 is a top perspective view of a top side of a stationary base of the movable bassinet assembly of FIG. 1 in accordance with one or more example embodiments of the present disclosure.

When the movable bassinet assembly 100 is assembled, the curved track 216 of the track portion 202 may be disposed within the stationary base 104. For example, as shown in FIG. 6, a top side 118 of the stationary base 104 may include one or more slots 120 configured to receive the track portion 202 therein. During assembly, the track portion 202 may be placed into the slots 120 so that the curved track 216 is positioned below the top side 118 of the stationary base 104. The attachment portion 214 may sit within the slot 120 in a manner that enables at least some movement of the track portion 202 within the slot 120. When the bassinet 102 is moving relative to the stationary base 104, the track portion 202 may move up and down relative to the stationary base 104 due to the curvature of the curved track 216. To prevent the track portion 202 from disconnecting from the stationary base 104, the track portion 202 also includes a retention portion 218 disposed substantially perpendicular to the curved track 216. The retention portion 218 may be wider than the slot 120 so that the retention portion 218 is effective to maintain the track portion 202 within the slot 120 and the stationary base 104. The slots 120 may also have secondary retention portions 122 configured to further secure the track portion 202 into place from the top side 118 of the stationary base 104.

The curved track 116 may also include a track surface 220 configured to contact a respective wheel 208 of the track assembly 200. Generally, the track surface 220 may have a radius of curvature that is small enough to maintain the translational motion of the bassinet 102, but large enough to minimize the bassinet's vertical motion. For example, a track surface 220 with too small of a radius of curvature may generate significant vertical motion that may be disruptive or unsettling to a baby. However, a track surface 220 with too large of a radius of curvature may not be effective to maintain the translational motion of the bassinet 102. In some embodiments, the track surface 220 may be configured to replicate a particular type of movement. For example, the track surface 220 may be configured to replicate or simulate a swaying motion or an asymmetric rocking motion.

Figure 7:
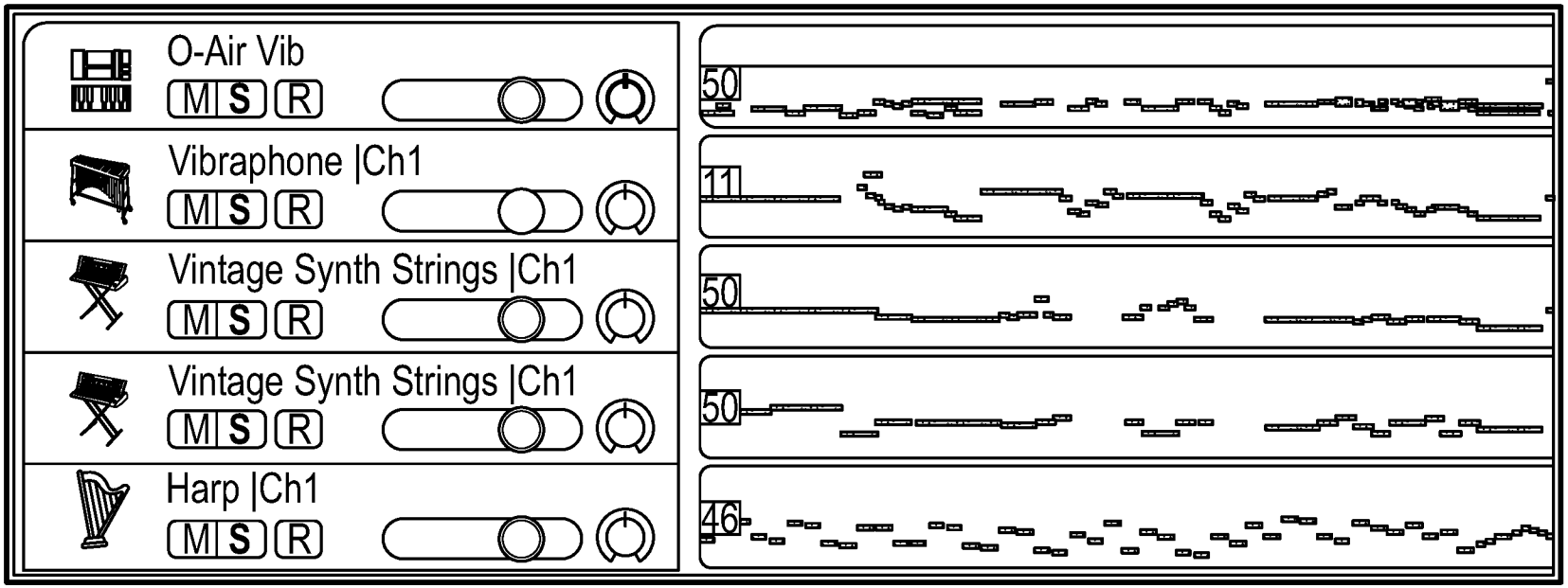
FIGS. 7-8 illustrate control modules for non-sound stimulation in accordance with one or more example embodiments of the present disclosure.
Figure 8:
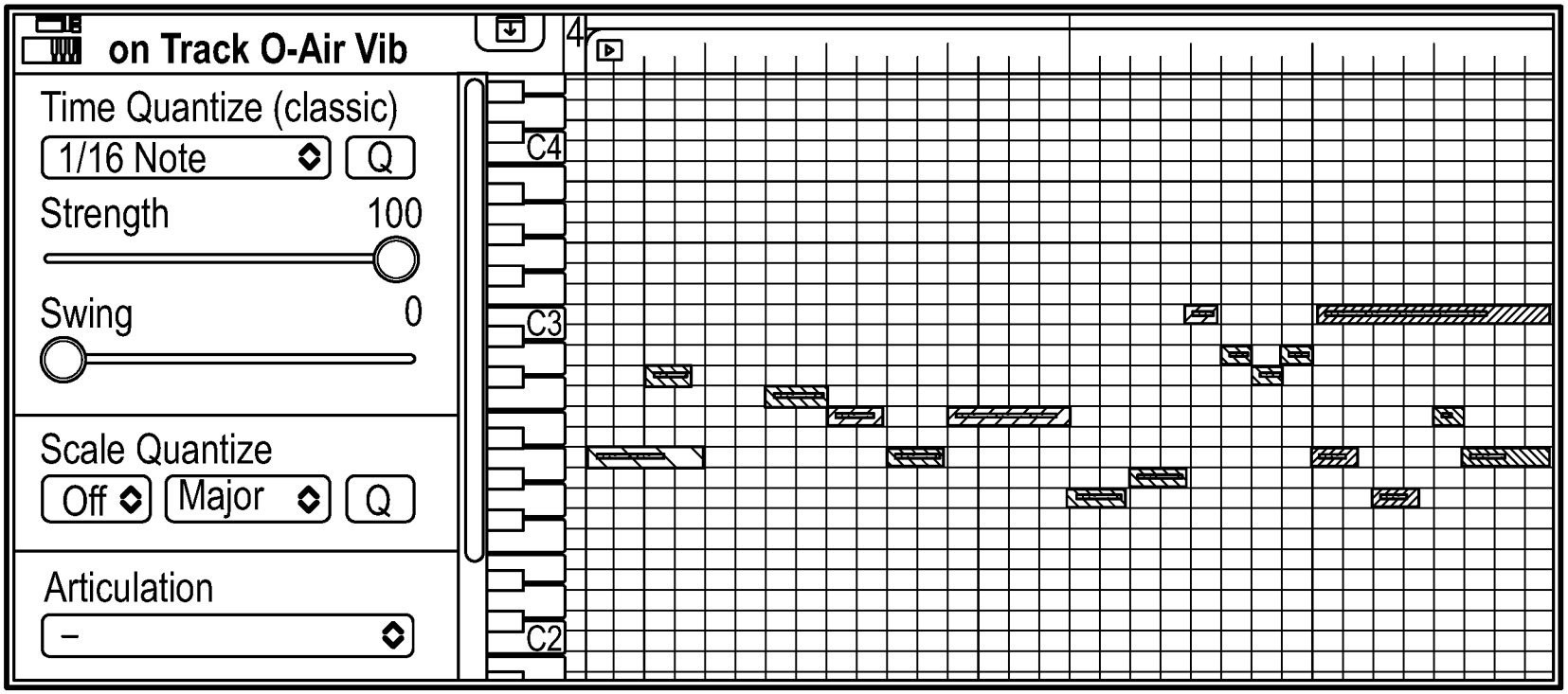

Referring generally to FIGS. 7-8, motion of the movable bassinet assembly may be coupled with at least one secondary stimulation. In embodiments, the secondary stimulation may be sound. In embodiments, the secondary stimulation may be tactile, such as vibration. In other embodiments, multiple sources of secondary stimulation may be selected, such that the secondary stimulations are synchronized with one another and/or the motion of the bassinet assembly. The source (or sources) of secondary stimulation may be selected via the control panel on the stationary base portion. For example, a gentle vibration may be configured to be synchronized with the motion of the movable bassinet assembly. Some embodiments may include MIDI formatted audio to create matching vibrations and sound, and provide control to users via a user interface. The MIDI files may include synced vibration frequencies, and the composed or transposed tracks can be quantized and adjusted for synchronization. Users can create custom files.

In embodiments where the secondary stimulation is vibration, vibration notes may be adjusted and quantized for length, velocity, pitch, duration, etc. Data may also be incorporated into the vibration profile to automate control of the vibrations. Users may also generate vibration profiles with said automated data, and may control the parameters of said profiles as previously described. In embodiments, the user may select the vibration via an on-off toggle. In other embodiments, the user may select a vibration profile corresponding with different vibrations.

One or more operations of the methods or uses of FIGS. 7-8 may have been described above as being performed by a user device, or more specifically, by one or more program module(s), applications, or the like executing on a device. It should be appreciated, however, that any of the operations of the methods or uses of FIGS. 7-8 may be performed, at least in part, in a distributed manner by one or more other devices, or more specifically, by one or more program module(s), applications, or the like executing on such devices. In addition, it should be appreciated that the processing performed in response to the execution of computer-executable instructions provided as part of an application, program module, or the like may be incorporated with the methods and/or uses disclosed herein. While the operations of the methods or uses of FIGS. 7-8 may be described in the context of the illustrative devices, it should be appreciated that such operations may be implemented in connection with numerous other device configurations.

Though the disclosed examples include particular arrangements of a number of parts, components, features, and aspects, the disclosure it not limited to only those examples of arrangements shown. Any one or more of the parts, components, features, and aspects of the disclosure can be employed alone or in other arrangements of any two or more of the same.

Although certain product features, functions, components, and parts have been described herein in accordance with the teachings of the present disclosure, the scope of coverage is not limited thereto. On the contrary, this disclosure covers all embodiments of the teachings of the disclosure that fairly fall within the scope of permissible equivalents.

Unless otherwise noted, the terms used herein are to be understood according to conventional usage by those of ordinary skill in the relevant art. In addition to the definitions of terms provided below, it is to be understood that as used in the specification and in the claims, "a" or "an" can mean one or more, depending upon the context in which it is used.

Throughout this application, the term "include," "include (s)," or "including" means "including but not limited to." Note that certain embodiments may be described relating to a single component, but the corresponding description should be read to include embodiments of two or more components. Different features, variations, and multiple different embodiments are shown and described herein with various details. What has been described in this application at times in terms of specific embodiments is done for illustrative purposes only and without the intent to limit or suggest that what has been conceived is only on particular embodiment or specific embodiments. It is to be understood that this disclosure is not limited to any specific embodiment or enumerated variations. Many modifications, variations, and other embodiments will come to mind of those skilled in the art, which are intended to be and are in fact covered by this disclosure. It is indeed intended that the scope of this disclosure should be determined by a proper legal interpretation and construction of the disclosure, including equivalents, as understood by those of skill in the art relying upon the complete disclosure present at the time of filing.

Conditional language used herein, such as, among others, "can,", "could," "might," or "may," unless specifically stated otherwise, or otherwise understood within the context as used, generally is intended to convey that certain embodiments include, while other embodiments do not include, certain features, elements, or functional capabilities. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

What has been described herein in the present specification and annexed drawings includes examples of systems, methods, apparatuses, devices, and techniques that, individually and in combination, provide for a moving bassinet assembly. It is, of course, not possible to describe every conceivable combination of components and/or methods for purposes of describing the various elements of the disclosure, but it can be recognized that many further combinations and permutations of the disclosed elements are possible. Accordingly, it may be apparent that various modifications can be made to the disclosure without departing from the scope thereof. In addition, or as an alternative, other embodiments of the disclosure may be apparent from consideration of the specification and annexed drawings, and practice of the disclosure as presented herein. It is intended that the examples put forth in the specification and annexed drawings be considered, in all respects, as illustrative and not limiting. Although specific terms are employed herein, they are used in a generic and descriptive sense only and not for purposes of limitation.

What is claimed is:

1. A bassinet assembly comprising:

a bassinet;

a stationary base; and at least one track assembly configured to engage with the bassinet and the base, the at least one track assembly comprising an inverted curved track and a wheel assembly;

wherein the bassinet is configured for translational motion about the stationary base via the at least one track assembly.

2. The bassinet assembly of claim 1, wherein the at least one track assembly comprises at least one idle track assembly and a drive track assembly, wherein the drive track assembly is configured to effectuate the translational motion of the bassinet.

3. The bassinet assembly of claim 2, wherein the drive track assembly comprises a drive track and a drive wheel assembly, wherein the drive track assembly is configured to actively rotate the drive wheel assembly.

4. The bassinet assembly of claim 2, wherein the drive assembly comprises a motor configured to rotate the drive wheel assembly.

5. The bassinet assembly of claim 4, comprising a controller configured to:

receive a user input; and cause the motor to rotate the drive wheel assembly at a predetermined speed in response to the user input.

6. The bassinet assembly of claim 1, wherein the inverted curved track is fixedly attached to a lower side of the bassinet and the wheel assembly is disposed within the stationary base.

7. The bassinet assembly of claim 6, wherein the inverted curved track comprises a track portion and a base portion, wherein the base portion is fixedly attached to the lower side of the bassinet, such that a concave curved edge of the inverted curved track faces the stationary base.

8. The bassinet assembly of claim 6, wherein the wheel assembly comprises a wheel and an axle, wherein the axle is fixedly attached within the stationary base, and wherein the wheel is rotatably disposed around the axle.

9. The bassinet assembly of claim 1, wherein the stationary base comprises at least one rectangular cutout on an upper side thereof that is configured to receive the track therein, and wherein at least a portion of the track is disposed within the stationary base when the track is positioned within the rectangular cutout.

10. The bassinet assembly of claim 9, wherein the track comprises a retention member configured to maintain the track within the rectangular cutout.

11. The bassinet assembly of claim 9, wherein the rectangular cutout is sized to permit translational motion of the track within the rectangular cutout, wherein the translational motion of the track corresponds with proportional translational motion of the bassinet.

12. The bassinet assembly of claim 1, further comprising a controller configured to control the translational motion of the bassinet.

13. The bassinet assembly of claim 12, further comprising a control panel, wherein the control panel is configured to send a signal to the controller instructing the controller to execute a command regarding the translational motion of the bassinet.

14. The bassinet assembly of claim 13, wherein the command regarding the translational motion of the bassinet is a command regarding a speed, a magnitude, or a duration of the translational motion.

15. A bassinet assembly comprising:

a bassinet;

a stationary base comprising:

a primary base portion; and a top base portion positioned atop the primary base portion; and a plurality of track assemblies, each of the plurality of track assemblies comprising a curved track and a wheel assembly;

wherein the curved track is fixedly attached to the bassinet, and wherein the wheel assembly is disposed within the primary base portion of the stationary base; and wherein at least one of the plurality of track assemblies is a drive assembly, wherein the wheel assembly is a drive wheel assembly configured to effectuate translational motion of the bassinet about the stationary base.

16. The bassinet assembly of claim 15, further comprising a control panel and a controller, wherein the control panel is configured to receive a user input regarding at least one setting for the bassinet assembly and transmit the user input to the controller, and wherein the controller is configured to transmit a command to the drive wheel assembly based on the user input.

17. The bassinet assembly of claim 16, wherein the at least one setting is a speed of the translational motion for the bassinet, and wherein the user input corresponds with a low speed, a medium speed, or a high speed setting.

18. A method of implementing translational motion in a children's product, the method comprising:

providing a track assembly configured to engage the children's product and a stationary base, the track assembly comprising:

a track portion fixedly attached to the children's product and at least partially disposed within the stationary base; and a wheel assembly disposed within the stationary base;

wherein the track portion and the wheel assembly are in contact within the stationary base; and causing the track assembly to enact translational motion via the contact between the track portion and the wheel assembly.

* * * * *